US010228181B2

(12) United States Patent
Justice, Jr.

(10) Patent No.: US 10,228,181 B2
(45) Date of Patent: Mar. 12, 2019

(54) REFRIGERATOR COVER

(71) Applicant: Robert Justice, Jr., Decatur, GA (US)

(72) Inventor: Robert Justice, Jr., Decatur, GA (US)

( * ) Notice: Subject to any disclaimer, the term of this patent is extended or adjusted under 35 U.S.C. 154(b) by 0 days.

(21) Appl. No.: 14/970,539

(22) Filed: Dec. 16, 2015

(65) Prior Publication Data

US 2017/0248361 A1 Aug. 31, 2017

(51) Int. Cl.

| | |
|---|---|
| ***F25D 23/02*** | (2006.01) |
| ***B65D 25/20*** | (2006.01) |
| ***F25D 23/10*** | (2006.01) |
| *F25D 3/08* | (2006.01) |

(52) U.S. Cl.

CPC ..... *F25D 23/02* (2013.01); *F25D 23/10* (2013.01); *F25D 3/08* (2013.01); *F25D 2400/18* (2013.01)

(58) Field of Classification Search

CPC .... F25D 23/02; F25D 2400/18; F25D 23/063; F25D 23/065; F25D 23/028; F25D 3/06; F25D 3/08; A47B 2096/208

USPC ..... D7/604, 606; 62/457.1, 530

See application file for complete search history.

(56) References Cited

U.S. PATENT DOCUMENTS

| | | | | | |
|---|---|---|---|---|---|
| 4,566,292 | A | * | 1/1986 | Parmet | F25D 3/08 215/286 |
| D289,598 | S | * | 5/1987 | Parmet | D7/606 |
| D369,946 | S | * | 5/1996 | Miller | D7/606 |
| D389,672 | S | * | 1/1998 | Antao | D15/81 |
| D434,607 | S | * | 12/2000 | Hansen | D7/606 |
| D472,106 | S | * | 3/2003 | Cantor | D7/606 |
| D519,790 | S | * | 5/2006 | Loving | D7/606 |
| D521,322 | S | * | 5/2006 | Loving | D7/606 |
| 7,168,263 | B1 | * | 1/2007 | Zenner | F25D 3/06 62/457.1 |
| D537,669 | S | * | 3/2007 | Loving | D7/332 |
| D661,537 | S | * | 6/2012 | Hughes, II | D7/301 |
| D674,413 | S | * | 1/2013 | Euna | D15/85 |
| D685,228 | S | * | 7/2013 | Daugherty | D7/606 |
| D713,213 | S | * | 9/2014 | Day | D7/606 |
| D749,911 | S | * | 2/2016 | Diamond | D7/606 |
| D749,912 | S | * | 2/2016 | Diamond | D7/606 |
| D779,870 | S | * | 2/2017 | Serrano | D7/332 |
| 9,719,718 | B2 | * | 8/2017 | Piendl | F25D 23/063 |
| D797,819 | S | * | 9/2017 | Fuller | D15/85 |
| 2004/0183413 | A1 | * | 9/2004 | Koo | F25D 23/02 312/401 |
| 2006/0273699 | A1 | * | 12/2006 | Bauer | F25D 23/02 312/109 |

(Continued)

*Primary Examiner* — J. Gregory Pickett
*Assistant Examiner* — Gideon Weinerth
(74) *Attorney, Agent, or Firm* — Cygnet IP Law, P.A.; Stephen W. Aycock, II

(57) ABSTRACT

Some implementations can include a refrigerator cover having a body portion with a first side, a second side and a top. The first side, second side and top each having generally flat interior surfaces defining an interior space of the cover and each having generally rounded exterior surfaces formed so as to generally resemble a football helmet. The cover can also include a front door attached to the body portion via one or more rotational members, the front door having a generally flat rear surface adjacent a front opening of the body portion when the front door is in a first position, the front door having a protruding member extending from a front surface, where the protruding member is formed generally in a shape of a football helmet face guard.

12 Claims, 5 Drawing Sheets

(56) References Cited

U.S. PATENT DOCUMENTS

| | | | | |
|---|---|---|---|---|
| 2008/0024047 | A1* | 1/2008 | Juo | A47F 3/043 312/405 |
| 2010/0116005 | A1* | 5/2010 | Jung | A47L 15/4251 68/212 |
| 2010/0147602 | A1* | 6/2010 | Jung | D06F 39/005 178/18.06 |
| 2010/0242515 | A1* | 9/2010 | Kim | B44C 1/227 62/259.1 |
| 2010/0319383 | A1* | 12/2010 | Kim | F25D 23/028 62/264 |
| 2011/0132023 | A1* | 6/2011 | Hwang | F25D 23/065 62/449 |
| 2011/0210029 | A1* | 9/2011 | Ontjes | F17C 13/00 206/457 |
| 2011/0210130 | A1* | 9/2011 | Ontjes | F17C 1/14 220/694 |
| 2012/0216950 | A1* | 8/2012 | Jung | B44C 3/082 156/247 |
| 2014/0375200 | A1* | 12/2014 | Kim | F25D 23/02 312/405 |

* cited by examiner

REFRIGERATOR COVER

FIELD

Some implementations relate generally to refrigerator covers, and, more particularly, to refrigerator covers configured to fit over a small refrigerator and generally having a football helmet shape and football helmet style-face guard attached to the front door of the cover.

BACKGROUND

Small refrigerators are often used indoors (e.g., in family rooms, media rooms, dens, etc.) and in outdoor areas (e.g., patios, porches, lanais, etc.) where access to chilled beverages and food may be desirable. Many small refrigerators have a rectangular shape and typically a dark color (e.g., brown, black, gray, etc.). A need or desire may exist for a decorative cover for small refrigerators that may adapt the refrigerator to better suit the decor (e.g., sports team colors and/or decor) of a room or area in which the refrigerator is placed. Some embodiments were conceived in light of the above mentioned need or desire among other things.

SUMMARY

Some implementations can include a refrigerator cover comprising a body portion having a first side, a second side and a top, where the first side is joined to one side of the top and the second side is joined to an opposite side of the top, the first side, second side and top defining an interior space of the cover, the first side, second side and top each having generally rounded exterior surfaces formed so as to generally resemble a football helmet.

The cover can also include a front door attached to the body portion via one or more rotational members, the front door being configured to cover a front opening of the body portion when the front door is in a first position and being to reveal the front opening of the body portion when the front door is rotated about the one or more rotational members to a second position, the front door having a generally flat rear surface adjacent the front opening of the body portion when the front door is in the first position, the front door having a protruding member extending from a front surface, where the protruding member is formed so as to generally resemble a football helmet face guard. The one or more rotational members can include a hinge.

Some implementations can include a refrigerator cover comprising a body portion having a first side, a second side and a top, where the first side is joined to one side of the top and the second side is joined to an opposite side of the top, the first side, second side and top defining an interior space of the cover, the first side, second side and top each having generally rounded exterior surfaces formed so as to generally resemble a helmet.

The cover can also include a front door attached to the body portion via one or more rotational members, the front door being configured to cover a front opening of the body portion when the front door is in a first position and being to reveal the front opening of the body portion when the front door is rotated about the one or more rotational members to a second position, the front door having a generally flat rear surface adjacent the front opening of the body portion when the front door is in the first position, the front door having a protruding member extending from a front surface. The one or more rotational members can include a hinge.

In some implementations, the helmet can be formed generally in a shape of a race car driving helmet and the protruding member can be formed generally in a shape of a race car driving helmet face guard.

In some implementations, the helmet can be formed generally in a shape of baseball batting helmet and the protruding member can be formed in a shape of a visor portion of a baseball batting helmet.

In some implementations, the helmet can be formed generally in a shape of a hockey helmet and the protruding member can be formed generally in a shape of a hockey helmet face guard.

In some implementations, the helmet can be formed generally in a shape of an astronaut helmet and the protruding member can be formed generally in a shape of an astronaut helmet face shield.

In some implementations, the helmet can be formed generally in a shape of an underwater diving helmet and the protruding member can be formed generally in a shape of an underwater diving mask.

In some implementations, the helmet can be formed generally in a shape of a police helmet and the protruding member can be formed generally in a shape of a police helmet face shield.

In some implementations, the helmet can be formed generally in a shape of a firefighting helmet and the protruding member can be formed generally in a shape of a firefighting helmet face shield.

In some implementations, the helmet can be formed generally in a shape of a fighter aircraft pilot helmet and the protruding member can be formed generally in a shape of a fighter aircraft pilot helmet face shield.

In some implementations, the helmet can be formed generally in a shape of a military combat helmet and the protruding member can be formed generally in a shape of a military combat helmet face shield.

In some implementations, the helmet can be formed generally in a shape of a construction hardhat and the protruding member can be formed generally in a shape of a construction hardhat visor.

DETAILED DESCRIPTION

It will be appreciated that the example football-style helmet refrigerator covers shown in the figures are for illustration purposes. The refrigerator cover as disclosed herein can be configured and constructed having other shapes such as a race car driving helmet, baseball batting helmet, hockey helmet, astronaut helmet, diving helmet, police helmet, firefighter helmet, fighter aircraft pilot helmet, military helmet, construction hardhat, etc. In addition to having a shape similar to that of a sport helmet, the refrigerator cover can have colors and or designs applied matching a team's colors and/or logo.

Figure 1:
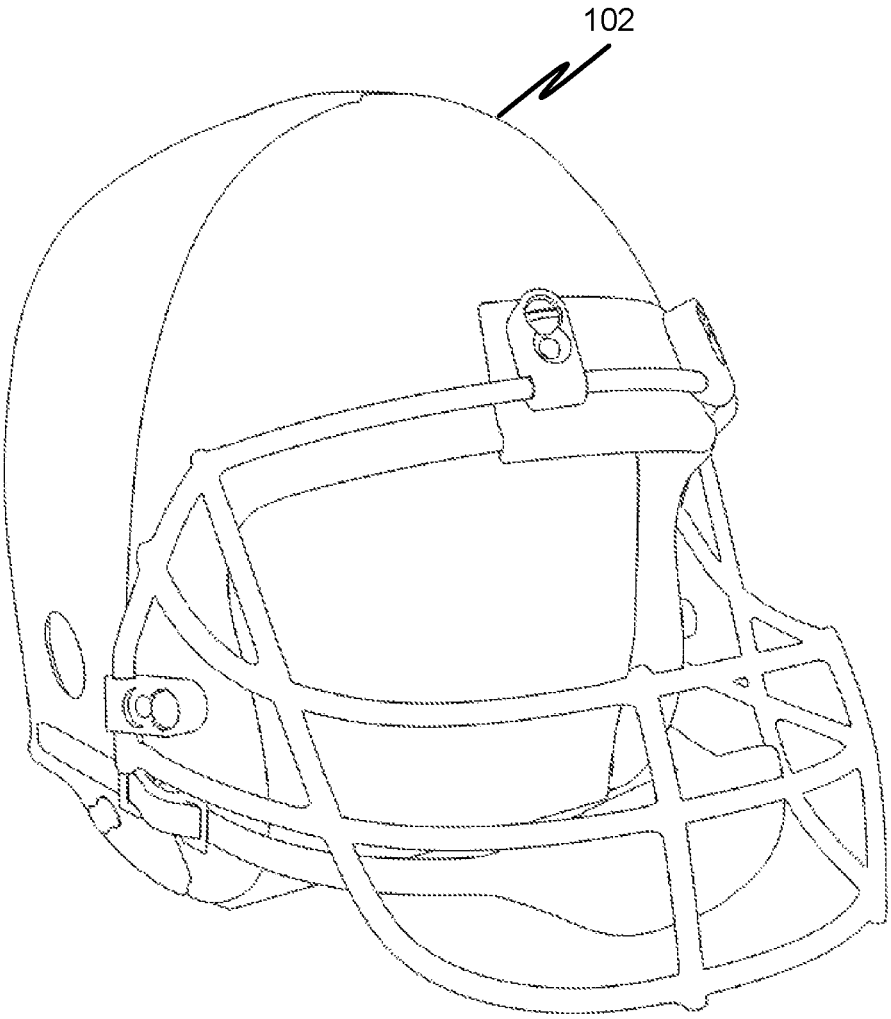
FIG. 1 shows a diagram of an example football helmet style refrigerator cover in accordance with some implementations.

FIG. 1 shows a diagram of an example football helmet style refrigerator cover 102 in accordance with some implementations. The cover can be formed from plastic (e.g., polycarbonate, nylon, polyvinylchloride, or the like), metal, wood or other suitable material.

Figure 2:
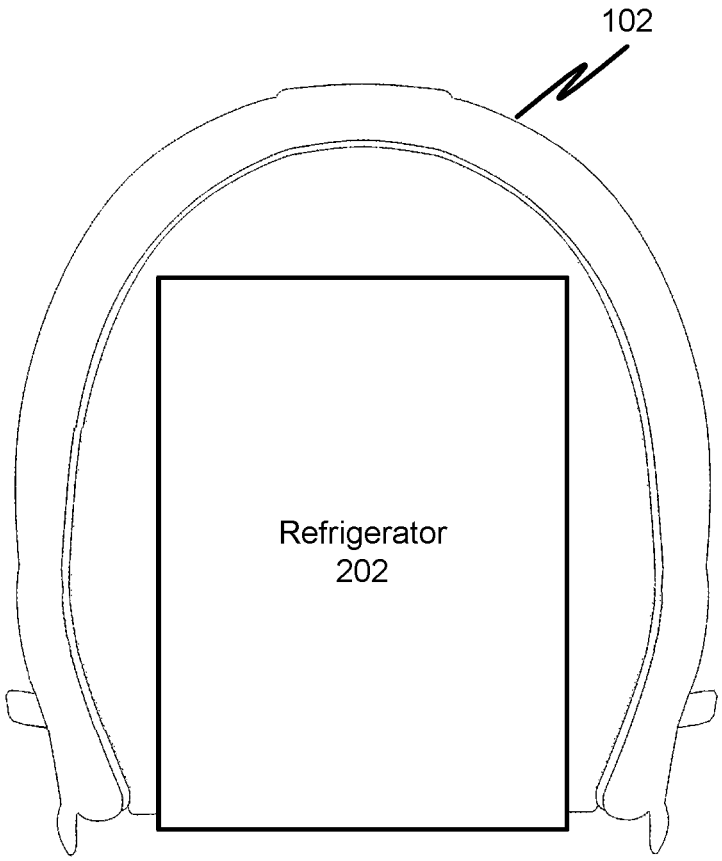
FIG. 2 shows a rear view diagram of an example football helmet style refrigerator cover in accordance with some implementations.
Figure 3:
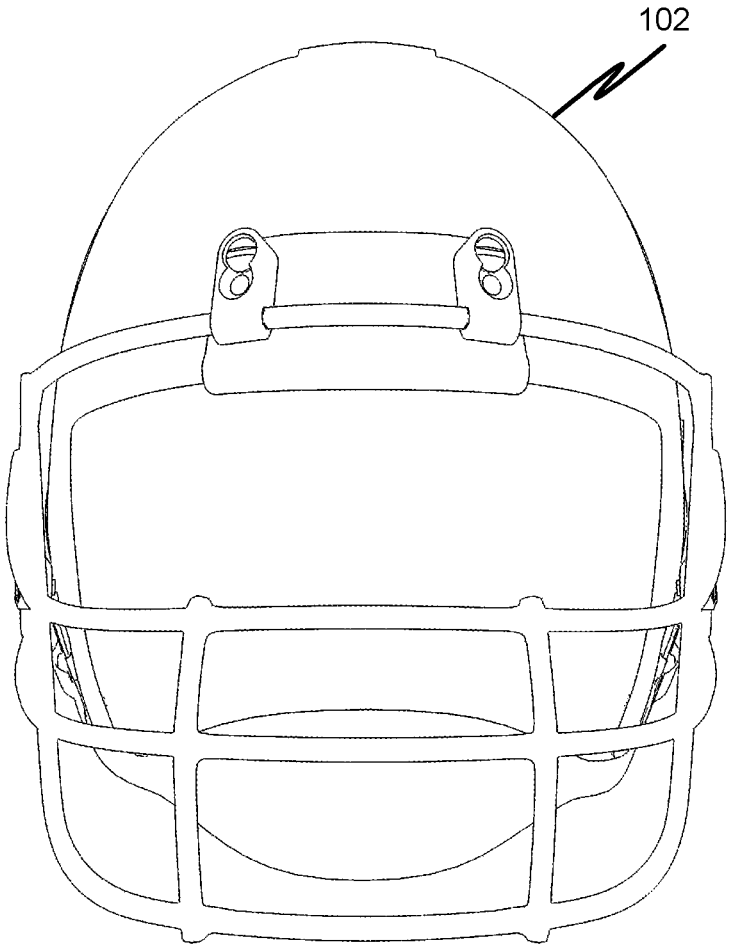
FIG. 3 shows a front view diagram of an example football helmet style refrigerator cover in accordance with some implementations.

FIG. 2 shows a rear view diagram of an example football helmet style refrigerator cover 102 placed over a refrigerator 202. FIG. 3 shows a front view diagram of an example football helmet style refrigerator cover 102.

Figure 4:
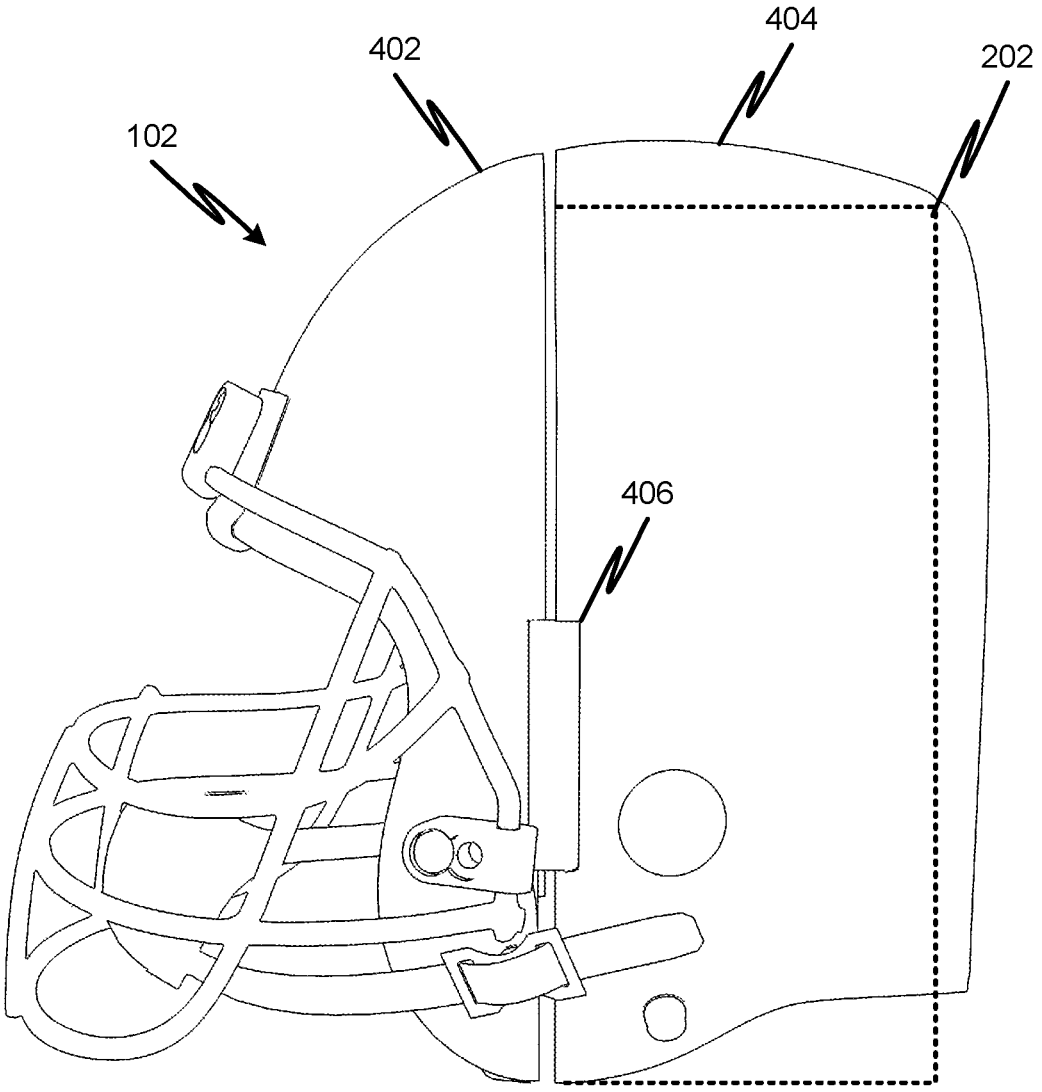
FIG. 4 shows a side view diagram of an example football helmet style refrigerator cover in accordance with some implementations.

FIG. 4 shows a side view diagram of an example football helmet style refrigerator cover 102 in accordance with some implementations. The cover 102 has a front door 402, a body portion 404, and one or more rotatable members 406 (e.g., one or more hinges). The cover 102 is shown placed over a refrigerator 202. In FIG. 4, the front door 402 is shown in a first position (i.e., a closed position) so as to cover a front opening of the body portion and a front door of the refrigerator 202.

Figure 5:
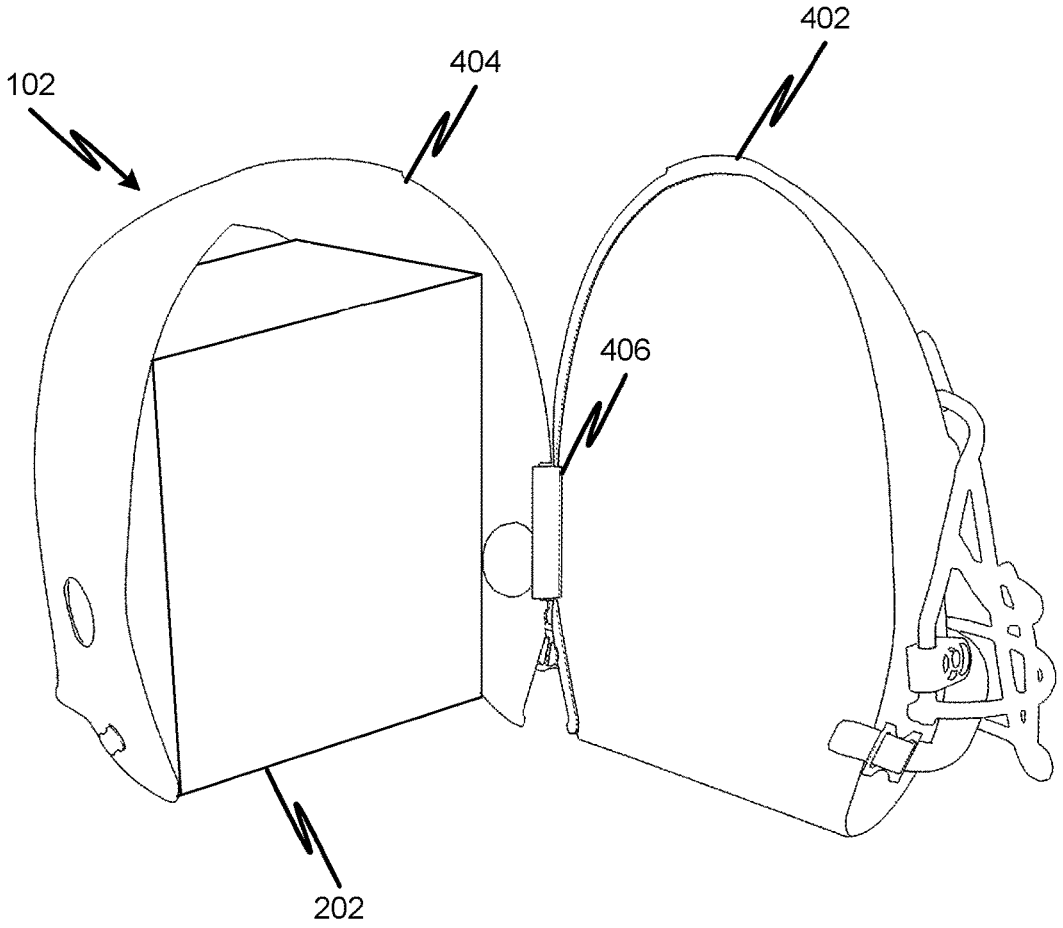
FIG. 5 shows a diagram of an open example football helmet style refrigerator cover in accordance with some implementations.

FIG. 5 shows a diagram of an open example football helmet style refrigerator cover 102 in accordance with some implementations. In FIG. 5, the front door 402 is in a second position (i.e., an open position) to reveal a front opening of the body portion 404 and the front of the refrigerator 202.

While some implementations have been described in terms of a general embodiment with several specific modifications, it is recognized that persons skilled in this art will readily perceive many other modifications and variations of the embodiments described above. Applicant intends to embrace any and all such modifications, variations and embodiments.

What is claimed is:

1. A refrigerator cover comprising:

a body portion having a first side, a second side, a top, a front opening and a bottom opening, where the first side is joined to one side of the top and the second side is joined to an opposite side of the top, the first side, the second side and the top each having generally flat interior surfaces defining an interior space of the refrigerator cover, the first side, the second side and the top each having generally rounded exterior surfaces formed so as to generally resemble a helmet; and a front door attached to the body portion via one or more rotational members, the front door configured to cover the front opening of the body portion when the front door is in a first position and configured to reveal the front opening of the body portion when the front door is rotated about the one or more rotational members to a second position, the front door having a generally flat rear surface adjacent the front opening of the body portion when the front door is in the first position, the front door having a protruding member extending from a front surface.

2. The refrigerator cover of claim 1, wherein the helmet is formed generally in a shape of a race car driving helmet and the protruding member is formed generally in a shape of a race car driving helmet face guard.

3. The refrigerator cover of claim 1, wherein the helmet is formed generally in a shape of a baseball batting helmet and the protruding member is formed generally in a shape of a baseball batting helmet visor.

4. The refrigerator cover of claim 1, wherein the helmet is formed generally in a shape of a hockey helmet and the protruding member is formed generally in a shape of a hockey helmet face guard.

5. The refrigerator cover of claim 1, wherein the helmet is formed generally in a shape of an astronaut helmet and the protruding member is formed generally in a shape of an astronaut helmet face shield.

6. The refrigerator cover of claim 1, wherein the helmet is formed generally in a shape of an underwater diving helmet and the protruding member is formed generally in a shape of an underwater diving mask.

7. The refrigerator cover of claim 1, wherein the one or more rotational members includes a hinge.

8. The refrigerator cover of claim 1, wherein the helmet is formed generally in a shape of a police helmet and the protruding member is formed generally in a shape of a police helmet face shield.

9. The refrigerator cover of claim 1, wherein the helmet is formed generally in a shape of a firefighting helmet and the protruding member is formed generally in a shape of a firefighting helmet face shield.

10. The refrigerator cover of claim 1, wherein the helmet is formed generally in a shape of a fighter aircraft pilot helmet and the protruding member is formed generally in a shape of a fighter aircraft pilot helmet face shield.

11. The refrigerator cover of claim 1, wherein the helmet is formed generally in a shape of a military combat helmet and the protruding member is formed generally in a shape of a military combat helmet face shield.

12. The refrigerator cover of claim 1, wherein the helmet is formed generally in a shape of a construction hardhat and the protruding member is formed generally in a shape of a construction hardhat visor.

* * * * *